US010598374B2

(12) United States Patent
Wang et al.

(10) Patent No.: US 10,598,374 B2
(45) Date of Patent: Mar. 24, 2020

(54) FUEL NOZZLE

(71) Applicant: PRATT & WHITNEY CANADA CORP., Longueuil (CA)

(72) Inventors: Yen-Wen Wang, Mississauga (CA); Nigel Davenport, Hillsburgh (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 293 days.

(21) Appl. No.: 15/667,757

(22) Filed: Aug. 3, 2017

(65) Prior Publication Data

US 2017/0328558 A1 Nov. 16, 2017

Related U.S. Application Data

(62) Division of application No. 14/505,787, filed on Oct. 3, 2014, now Pat. No. 9,752,774.

(51) Int. Cl.

| | |
|---|---|
| ***F23D 11/00*** | (2006.01) |
| ***F23D 11/38*** | (2006.01) |
| ***F23D 11/10*** | (2006.01) |
| ***F23R 3/28*** | (2006.01) |
| ***F23R 3/12*** | (2006.01) |

(52) U.S. Cl.

CPC ..... *F23D 11/383* (2013.01); *F23D 11/102* (2013.01); *F23D 11/103* (2013.01); *F23D 11/107* (2013.01); *F23R 3/12* (2013.01); *F23R 3/286* (2013.01); *F23D 2900/14021* (2013.01)

(58) Field of Classification Search

CPC .... F23D 11/102; F23D 11/103; F23D 11/383; F23D 2900/14021; F23R 3/286; F23R 3/12

See application file for complete search history.

(56) References Cited

U.S. PATENT DOCUMENTS

| | | | | |
|---|---|---|---|---|
| 4,133,485 | A | 1/1979 | Bouvin | |
| 5,813,847 | A | 9/1998 | Eroglu et al. | |
| 6,276,141 | B1 | 8/2001 | Pelletier | |
| 6,289,676 | B1 | 9/2001 | Prociw et al. | |
| 6,289,677 | B1 | 9/2001 | Prociw et al. | |
| 7,454,914 | B2 | 11/2008 | Prociw | |
| 7,766,251 | B2 | 8/2010 | Mao et al. | |
| 8,096,135 | B2 | 1/2012 | Caples | |
| 8,636,504 | B2 | 1/2014 | Krieger et al. | |
| 9,212,823 | B2 | 12/2015 | Boardman et al. | |
| 2007/0101727 | A1 | 5/2007 | Prociw | |
| 2009/0049838 | A1 * | 2/2009 | Oskin | F23R 3/14 60/734 |
| 2014/0090382 | A1 | 4/2014 | Sandelis et al. | |
| 2014/0090394 | A1 | 4/2014 | Low et al. | |

* cited by examiner

*Primary Examiner* — Todd E Manahan
*Assistant Examiner* — Katheryn A Malatek
(74) *Attorney, Agent, or Firm* — Norton Rose Fulbright Canada LLP

(57) ABSTRACT

A method of inducing swirl in pressurized air flowing through an air passageway of a fuel nozzle of a gas turbine engine includes inducing swirl in the pressurized air at an exit of the air passageway, by directing the pressurised air through helicoidal grooves formed at a downstream end of the air passageway. The swirling pressurized air exiting the air passageway is then directed into a mixing zone at a downstream end of the fuel nozzle.

6 Claims, 3 Drawing Sheets

FUEL NOZZLE

CROSS-REFERENCE TO RELATED APPLICATIONS

The present application is a divisional of U.S. patent application Ser. No. 14/505,787 filed Oct. 3, 2014, the entire content of which is incorporated herein by reference.

TECHNICAL FIELD

The application relates generally to gas turbines engines combustors and, more particularly, to fuel nozzles.

BACKGROUND

Gas turbine engine combustors employ a plurality of fuel nozzles to spray fuel into the combustion chamber of the gas turbine engine. The fuel nozzles atomize the fuel and mix it with the air to be combusted in the combustion chamber. The atomization of the fuel and air into finely dispersed particles occurs because the air and fuel are supplied to the nozzle under relatively high pressures. The fuel could be supplied with high pressure for pressure atomizer style or low pressure for air blast style nozzles providing a fine outputted mixture of the air and fuel may help to ensure a more efficient combustion of the mixture. Finer atomization provides better mixing and combustion results, and thus room for improvement exists.

SUMMARY

There is accordingly provided a method of inducing swirl in pressurized air flowing through an air passageway of a fuel nozzle of a gas turbine engine, the fuel nozzle including the air passageway and a fuel passageway extending through the fuel nozzle and meeting in a mixing zone at a downstream end of the fuel nozzle, the method comprising: inducing swirl in the pressurized air at an exit of the air passageway by directing the pressurised air through helicoidal grooves formed at a downstream end of the air passageway; and directing the swirling pressurized air exiting the air passageway into the mixing zone.

There is also provided a method of manufacturing a fuel nozzle for a gas turbine engine, the method comprising: providing a fuel nozzle body having an air passageway and a fuel passageway extending axially therethough, the air passageway and the fuel passageway meeting in a mixing zone formed at a downstream end of the fuel nozzle, the mixing zone located downstream of the air passageway and upstream of an exit lip of the fuel nozzle; and forming helicoidal grooves in an outer wall of the air passageway at a downstream end thereof that opens into the mixing zone, the helical grooves adapted to induce swirl in pressurized air flowing through the air passageway and into the mixing zone.

BRIEF DESCRIPTION OF THE DRAWINGS

Reference is now made to the accompanying figures in which.

DETAILED DESCRIPTION

Figure 1:
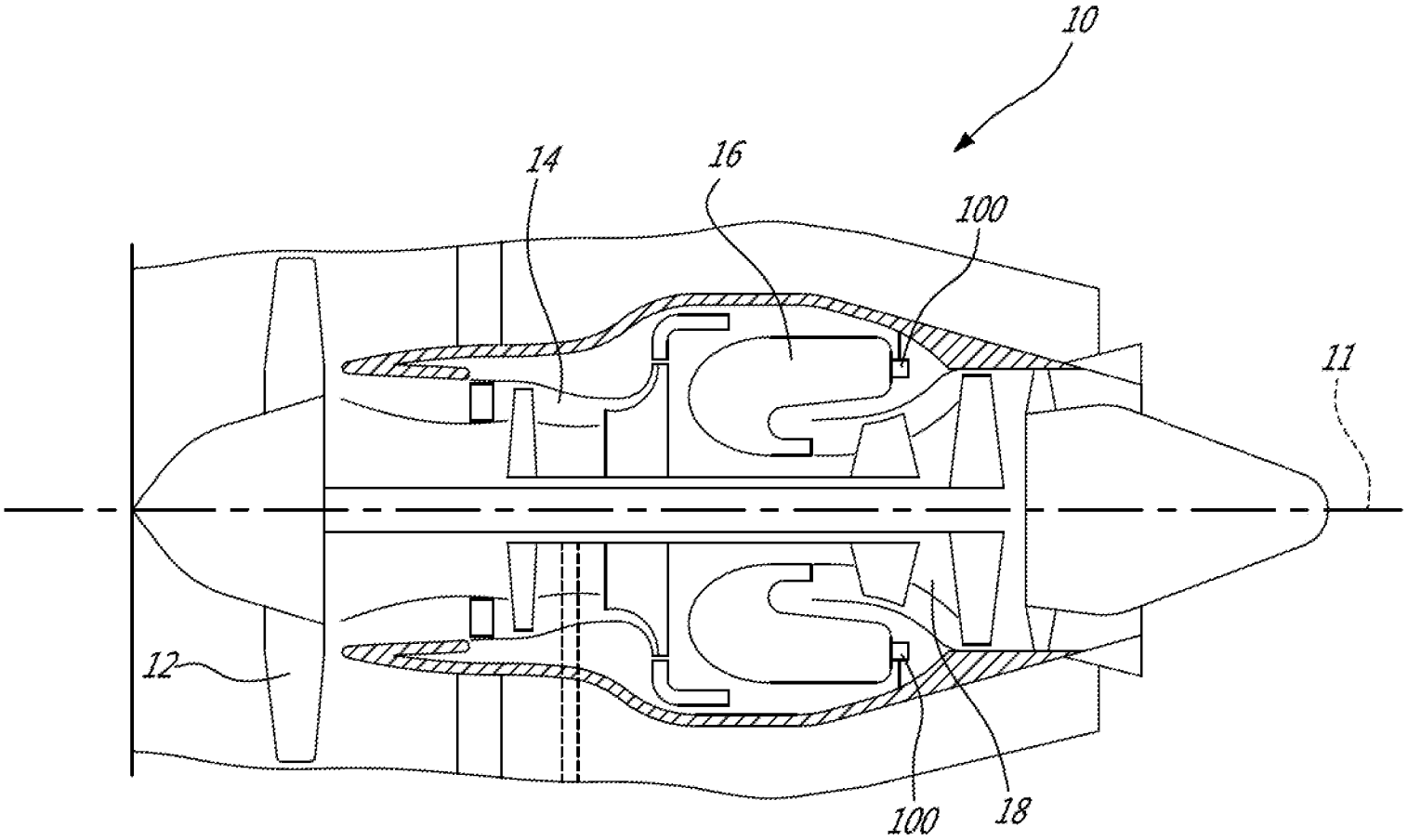
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The gas turbine engine 10 has one or more fuel nozzles 100 which supply the combustor 16 with the fuel which is combusted with the air in order to generate the hot combustion gases. The fuel nozzle 100 atomizes the fuel and mixes it with the air to be combusted in the combustor 16. The atomization of the fuel and air into finely dispersed particles occurs because the air and fuel are supplied to the nozzle 100 under relatively high pressures. The fuel could be supplied with high pressure for pressure atomizer style or low pressure for air blast style nozzles providing a fine outputted mixture of the air and fuel may help to ensure a more efficient combustion of the mixture. The nozzle 100 is generally made from a heat resistant metal or alloy because of its position within, or in proximity to, the combustor 16.

Figure 2:
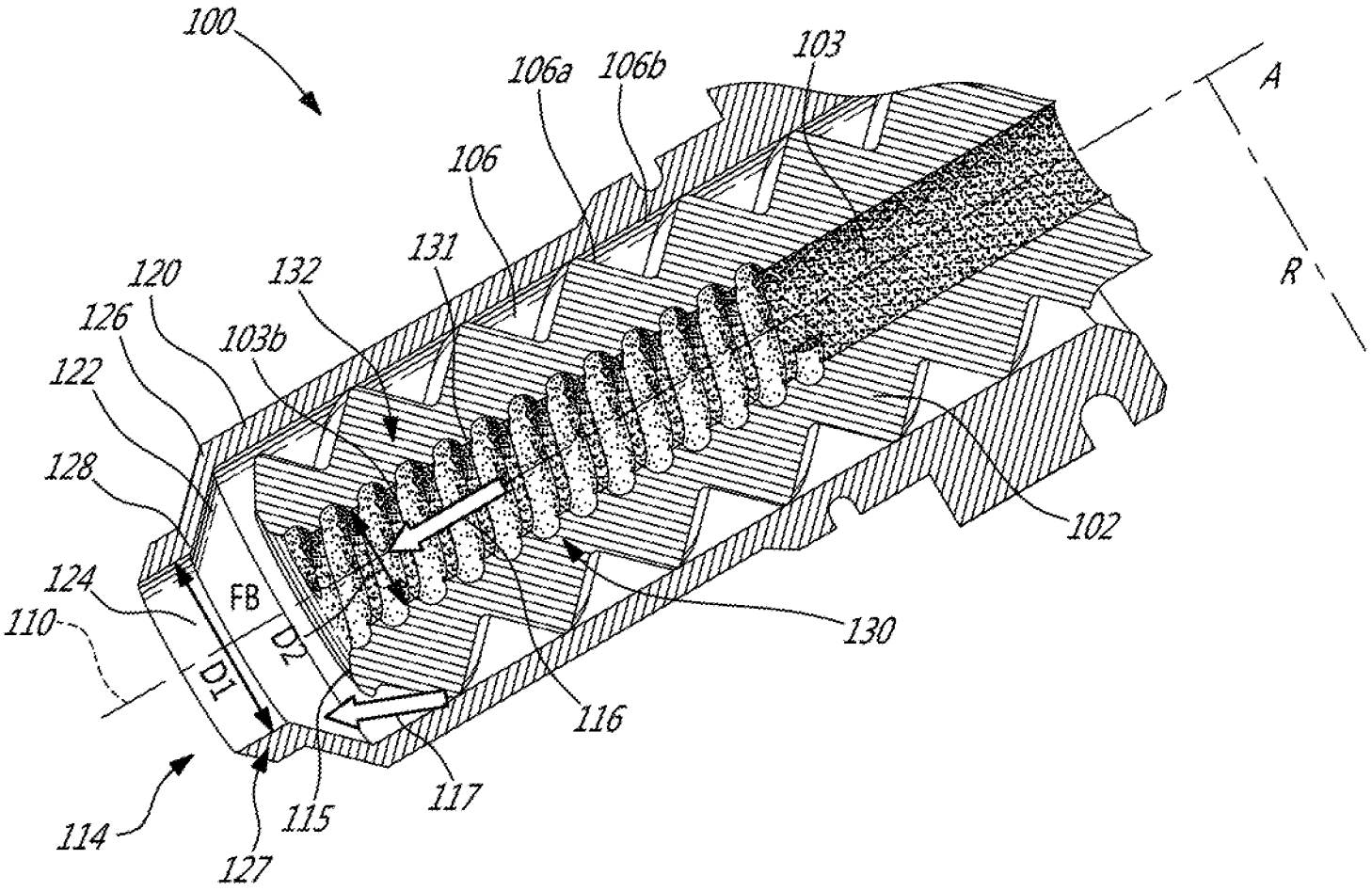
FIG. 2 is a partial schematic cross-sectional view of an embodiment of a nozzle for the combustor of the gas turbine engine of FIG. 1.

Turning now to FIG. 2, an embodiment of a fuel nozzle 100 will be described.

The nozzle 100 includes generally a cylindrical body 102 defining an axial direction A and a radial direction R. The body 102 is at least partially hollow and defines in its interior a primary air passageway 103 (a.k.a. core air) and a fuel passageway 106, all extending axially through the body 102.

The air passageway 103 and the fuel passageway 106 are aligned with a central axis 110 of the nozzle 100. The fuel passageway 106 is disposed concentrically around the air passageway 103. The fuel passageway 106 is annular. It is contemplated that the nozzle 100 could include more than one air passageway 103 and/or fuel passageway 106, annular or not. The size, shape, and number of the fuel 106 and air passageway 103 may vary depending on the flow requirements of the nozzle 100, among other factors. The nozzle 100 could, for example, include a secondary passageway around the fuel passageway 106.

The body 102 includes an upstream end (not shown) connected to sources of pressurised fuel and air and a downstream end 114 at which the air and fuel exit. The terms "upstream" and "downstream" refer to the direction along which fuel flows through the body 102. Therefore, the upstream end of the body 102 corresponds to the portion where fuel/air enters the body 102, and the downstream end 114 corresponds to the portion of the body 102 where fuel/air exits.

The primary air passageway 103 is defined by outer wall 103*b*. The outer wall 103*b* ends at exit end 115. The primary air passageway 103 carries pressurised air illustrated by arrow 116. The air 116 will be referred interchangeably herein to as "air", "jet of air", or "core flow of air".

The fuel passageway 106 is defined by inner wall 106*a* and outer wall 106*b* and carries a fuel film illustrated by arrow 117. The fuel 117 will be referred interchangeably herein to as "fuel" or "fuel film". In the embodiment shown in the Figures, the inner wall 106*a* has a helicoidal relief to induce swirl in the fuel film 117. By "swirl", one should understand any non-streamlined motion of the fluid, e.g. chaotic behavior or turbulence. It is contemplated that the inner wall 106*a* could be straight and/or could have grooves/ridges to induce swirl in the fuel film 117. It is also contemplated that the outer wall 106*b* could have grooves/ridges or that the inner wall 106*a* could be straight.

The fuel passage 106 is typically convergent (i.e. its cross-sectional area) may decrease along its length, from inlet to outlet) in the downstream direction at the downstream end 114. The outer wall 106*b* of the fuel passageway 106 converging at the downstream end 114 forces the annular fuel film 117 expelled by the fuel passageways 106 onto a jet of air 116 from the primary air passageway 103. The outer wall 106*b* of the fuel passageway 106 includes a first straight portion 120, a second converging portion 122 extending from a downstream end 126 of the straight portion 120, and a third straight portion 124 extending from a downstream end 128 of the converging portion 122. The third straight portion 124 forms an exit lip 127 of the nozzle 100. The lip exit 127 is disposed downstream relative to the exit end 115 of the primary air passageway 103. A diameter D1 of the outer wall 106*b* at the third straight portion 124 is slightly bigger than a diameter D2 of the outer wall 103*b* at the first straight portion 120.

A downstream end portion (or exit lip) 132 of the outer wall 103*b* of the air passageway 103 includes a surface treatment or swirl-inducing relief in the form of a plurality of grooves 130. The grooves 130 define a plurality of ridges 131 between them. The ridges 131 form abrupt transitions in the outer wall 103*b* and induce swirl in the core flow of air 116 as it exits the air passageway 103. By inducing swirl to the core air, shearing forces between the fuel film 117 and the air 116 may be increased. The shearing induces better mixing between the air and the fuel, better breakdown of the fuel. In turn, a size of the fuel droplets created may be reduced.

The grooves 130 in the illustrated embodiment are disposed up to the exit end 115 of the air passageway 103 in order to ensure that the air swirling is sustained to a fuel breakdown region FB, right after the exit of the air passageway 103 at about the third straight portion 124.

In the embodiment shown in the Figures, the grooves 130 are circumferential, helicoidal and of round cross-section. It is contemplated that the grooves 130 could have various shapes, for example, the grooves 130 could be axial, circular, of a rectangular cross-section, or of a triangular cross-section. The grooves 130 could be continuous or discontinuous.

Figure 3A:
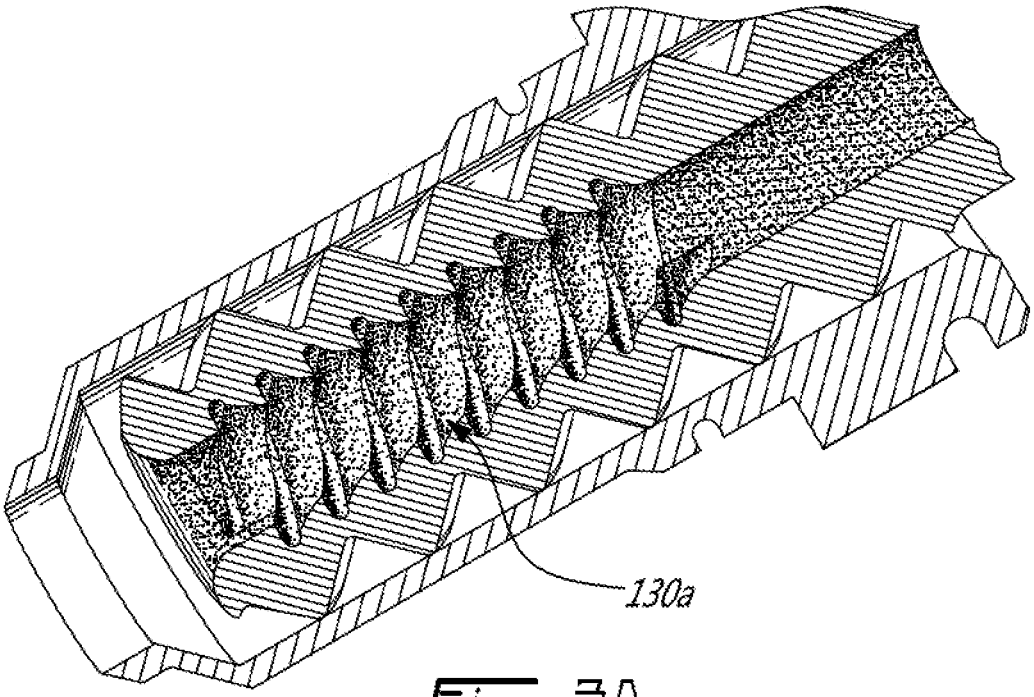
FIGS. 3A and 3B illustrate alternative designs of swirl-inducing reliefs of the nozzle of FIG. 2.
Figure 3B:
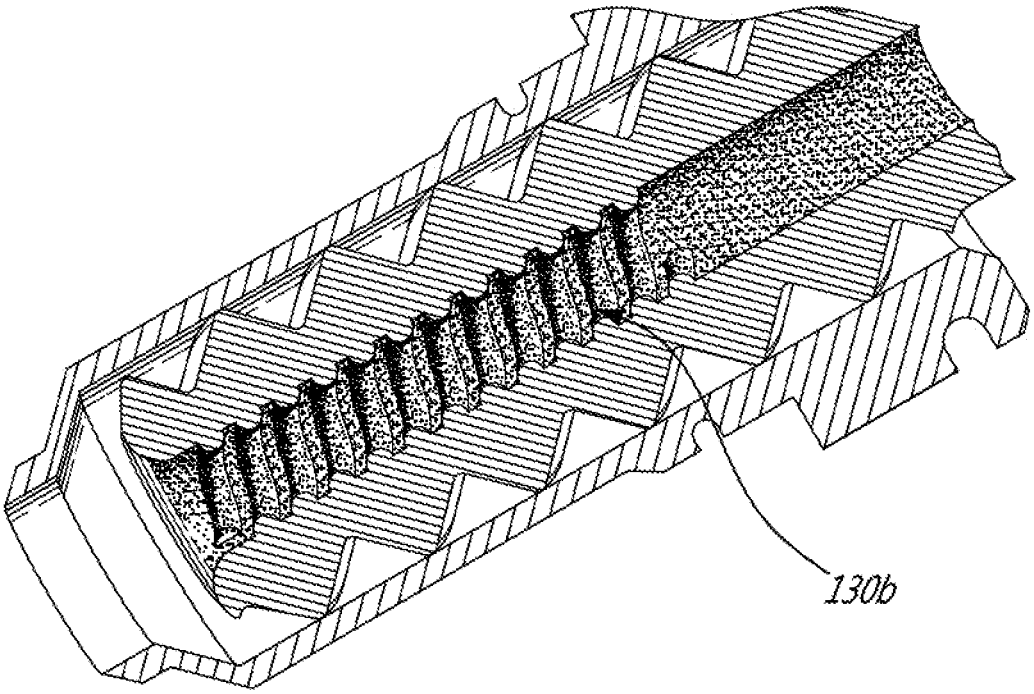

FIGS. 3A and 3B show examples of alternative of designs of the relief of the downstream end portion 132 of the air passageway 130. Grooves 130*a* in FIG. 3A have a sawtooth cross-section, and the grooves in FIG. 3B are replaced by protrusion 130*b* extending inwardly from the outer wall 103*b*. The protrusions 130*b* could also be substitute by vanes, which may be disposed circumferentially along the outer wall 103*b*.

The relief of the outer wall 103*b* may have various aspects, as long as it induces some sort of non-streamline behavior, e.g. turbulence, swirl or chaotic behavior in the air 116. The relief could be right at the exit end 115 of the air passageway 103, as shown in the Figures, or slightly upstream of the exit end 115.

The nozzle 100 may include one or more secondary air passageway(s) sandwiching the fuel film 117 with the core flow of air 116. The secondary air passageway(s) may include grooves similar to the grooves 130 or protrusion/ridges to induce swirl in the secondary stream of air. The grooves may be of the same type (e.g. helicoid) with the same characteristics (e.g. angle of the helix) as the grooves 130 or could be different.

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A method of inducing swirl in pressurized air flowing through an air passageway of a fuel nozzle of a gas turbine engine, the fuel nozzle including the air passageway and a fuel passageway extending through a body of the fuel nozzle and meeting in a mixing zone at a downstream end of the fuel nozzle, the method comprising:

inducing the swirl in the pressurized air at an exit of the air passageway by directing the pressurised air through helicoidal grooves formed at a downstream end of the air passageway, the air passage being centrally disposed within the body of the fuel nozzle;

directing fuel through the fuel passageway radially outward of the air passageway, the fuel passageway having an annular cross-sectional shape; and directing the swirling pressurized air exiting the air passageway into the mixing zone for mixing with the fuel from the fuel passageway.

2. The method of claim 1, wherein directing the pressurised air through the helicoidal grooves comprises directing the pressurised air onto the helicoidal grooves defined in an outer wall of the air passageway.

3. The method of claim 1, wherein directing the pressurised air through the helicoidal grooves comprises directing the pressurised air onto the helicoidal grooves extending on an inner surface of the outer wall of the air passageway up to the downstream end thereof.

4. The method of claim 1, further comprising converging the swirling pressurized air and fuel from the fuel passageway within the mixing zone toward an exit lip of the fuel nozzle, the mixing zone being defined within the downstream end of the fuel nozzle that terminates at the exit lip.

5. The method of claim 1, further comprising forming each groove of the helicoidal grooves having a circular cross-section.

6. The method of claim 1, further comprising forming each groove of the helicoidal grooves having a sawtooth cross-sectional shape.

* * * * *